US005937819A

United States Patent [19]

Kouchi et al.

[11] Patent Number: 5,937,819

[45] Date of Patent: Aug. 17, 1999

[54] CONFIGURATION OF OPERATING PANEL FOR AN ENGINE

[75] Inventors: Hiroyoshi Kouchi; Kazayuki Kobayashi; Shogo Nakamura, all of Aichi-ken, Japan

[73] Assignee: Mitsubishi Heavy Industries, Ltd., Tokyo, Japan

[21] Appl. No.: 09/047,472

[22] Filed: Mar. 25, 1998

[30] Foreign Application Priority Data

Mar. 25, 1997 [JP] Japan ..... 9-090231

[51] Int. Cl.[6] ..... F02B 77/00

[52] U.S. Cl. ..... 123/198 E

[58] Field of Search ..... 123/2, 198 DC, 123/198 E

[56] References Cited

U.S. PATENT DOCUMENTS 2,714,376 8/1955 Bakke et al. ..... 123/195 E
4,971,001 11/1990 Tharman ..... 123/198 DC

FOREIGN PATENT DOCUMENTS 567037 10/1993 European Pat. Off. .
U 64-47976 3/1989 Japan .
U 3-65827 6/1991 Japan .
U 6-40329 5/1994 Japan .

OTHER PUBLICATIONS

Patent Abstract of Shirakawa, JP 62–013737, Jan. 1987.

Patent Abstract of Ishizu, JP 01–041618, Feb. 1989.

*Primary Examiner*—Noah P. Kamen
*Attorney, Agent, or Firm*—Evenson, McKeown, Edwards & Lenahan, P.L.L.C.

[57] ABSTRACT

The object of this invention is to provide an operating panel for an engine which would require a smaller number of parts for throttle mechanism, operation panel and the related components. It also requires fewer assembly processes, and improves the outer appearance of the engine. In this operating panel, a cut-off switch to stop the engine is installed in a custom-designed cover, which has a cut-off terminal electrically isolated from a ground, and can electrically ground the cut-off terminal by making a contact with the throttle lever electrically grounded. The operational panel is easily fixed to the fan cover by engaging a protrusion and a hole. The operational panel has a groove to run a fuel pipe.

3 Claims, 5 Drawing Sheets

CONFIGURATION OF OPERATING PANEL FOR AN ENGINE

FIELD OF THE INVENTION

This invention concerns the configuration of the operating panel on a single-cylinder engine for general use in which the cylinder is canted with respect to the vertical.

BACKGROUND OF THE INVENTION

General-purpose engines used in industry usually have a centrifugal-type mechanical governor unit to hold down the maximum r.p.m. and maintain the minimum r.p.m. as needed. A mechanical governor unit of this sort converts to torque the centrifugal force generated by a flyweight as the crankshaft of the engine rotates. It outputs this torque mechanically to the exterior and compares it with the attendant force of the governor spring, which has been established previously. If the torque resulting from the centrifugal force exceeds the force of the spring, the governor unit operates the engine throttle to decrease the flow of the gas mixture and reduce the engine output. In this way the engine speed can be kept within specified bounds. Because this adjustment must be made while the engine is running, the throttle operating panel for an engine with this sort of governor unit must be easy to adjust. It must also be covered so as to prevent foreign matter from coming in contact with the operating panel.

Two configurations which have been proposed for the operating panel of a general-use single-cylinder engine with this type of governor unit are disclosed in the Japanese Patent Publication 6-40329 and 3-65827.

FIG. 6 is a frontal view of the general-use engine proposed in Patent Publication 6-40329.

In FIG. 6, 01 is the (entire) engine; 02 is the main portion of the said engine 01, including the crankcase. On the front of the said engine body 02 are fan cover 03, formed from a metal plate, and recoil starter 04, which starts the engine. 07 is the fuel tank, installed on top of engine body 02. 023 is the air cleaner.

In engine 01, throttle control 024, which controls the speed of the engine, is placed on top of carburetor and air cleaner 023. Cover 035 encloses the entire engine in order to keep it clean. This configuration makes it easy to run wiring from the exterior of the engine to lever 028, which controls the speed. It will also prevent the operation of the engine from being affected by another unit outside engine body 02. This design makes it easier to connect or disconnect a wire to speed lever 028.

In the configuration proposed in Patent Publication 3-65827, the throttle operation panel is located below the fuel tank in the space between the bottom of the fuel tank and the top of the fan cover. The components which constitute the operating panel are covered from the front. Holes are provided in the appropriate parts of the cover of the said operating panel for the throttle lever, the choke lever and the adjacent engine switch.

In the prior art engines described above, the fuel pipe runs along the side of either the cylinder (i.e., the engine body) or the fan cover. It is secured by means of clamps and bolts.

With the configuration proposed in Patent Publication 6-40329, the throttle control 024 is mounted on support plate 025, which itself is mounted on engine body 02 by a number of bolts. These components are protected by front cover 035. This configuration, then, requires a large number of parts, including the support plate, the bolts for the mounting surface, and the front cover. As a result, the parts count is extremely high.

With the configuration proposed in Patent Publication 3-65827, the throttle control (i.e., the governor unit) is simply covered by an operating panel. No improvements are made with regard to the interrelationship of the operating levers with the governor unit and the carburetor. In addition, the fuel pipe is mounted so that it runs along the side of either the engine body or the fan cover and it is secured to the engine body by means of clamps and bolts, which greatly increases the parts count.

SUMMARY OF THE INVENTION

When the operating panel is mounted in this way, as it is in general-use engines belonging to the prior art, a large number of parts is required on and around the operating panel, and a great deal of effort is needed to mount all the parts.

In view of the problems inherent in the prior art, the object of this invention is to provide a configuration for the operating panel of an engine which will reduce the number of parts needed for the throttle control, the operating panel and any related components; which will reduce the number of assembly processes needed to mount the relevant components; and which will improve the outward appearance of the engine.

To solve these problems, we designed the invention disclosed in this application so as to provide a configuration for the operating panel of a one-cylinder engine in which the cylinder is inclined with respect to the main portion of the engine including the crankcase, the fuel tank is placed in the upper part of the aforesaid engine, and there is a fan cover on the front of the engine.

Firstly this operating panel is distinguished by the fact that it has the following features: a custom-designed cover made of a resin material which encloses the uneven portion on the front of the engine between the upper part of the fan cover and the lower part of the fuel tank; a throttle lever which protrudes outward through a hole in the cover, which can rotate around a vertical shaft integral to the cover and placed on its interior, and which can be locked in any angular position desired; and a switch engaged with the throttle to stop the engine. This switch is isolated on the interior of the aforesaid cover and grounded by a ground terminal connected to the aforesaid throttle lever.

Secondly the invention disclosed in this application has the following additional features: there is a hole on the front of the aforesaid fan cover; on the bottom of the aforesaid custom-designed cover is a protrusion which engages in the aforesaid hole, and which has a groove that can be aligned with the aforesaid hole by moving the said custom-designed cover and fan cover with respect to each other; and there is a screw to fasten the custom-designed cover to the fan cover which is located a specified distance from the hole and protrusion. If when the protrusion engages in the hole the two covers are out of alignment, the groove is aligned with the edge of the hole, and the two covers are fastened together when the screw is tightened.

Thirdly the invention disclosed in this application has the following additional features: there is a groove with a semicircular cross section on the bottom of the custom-designed cover which is between the channel for the pipe connected to the fuel tank and the top of the fan cover.

According to the first embodiment of this invention, the governor unit, including the throttle control and governor levers, and the components accompanying this unit are enclosed from the front by a custom-designed cover formed of a resinous material. The vertical shaft, which serves as a mounting stage for the throttle control lever, is formed as a single piece with the cover. According to the second embodiment of this invention, the custom-designed cover is mounted to the fan cover without the use of a large number of bolts. Instead, a simpler method is used. A protrusion on the custom cover is fitted into a hole in the fan cover and anchored with a screw. According to the third embodiment of this invention, the fuel pipe is supported by being sandwiched between a circular groove which is integral to the custom cover and the top of the fan cover. No clamps or bolts are needed to fasten the pipe, so the parts count is much lower than that of a prior art design, and fewer assembly processes are required.

In addition to above, an electrical terminal for a stop switch is provided on the custom-designed cover, which is formed from a resinous material with insulating properties. When the terminal is connected to the throttle control lever, which is grounded to the fan cover, the engine can be turned off. This design obviates the need for additional insulation material for a stop switch.

DETAILED DESCRIPTION OF THE INVENTION

In this section we shall give a detailed explanation of an ideal embodiment of this invention with reference to the drawings.

To the extent that the dimensions, materials, shape and relative position of the components described in this embodiment need not be definitely fixed, the scope of the invention is not limited to the embodiment as described herein, which is meant to serve merely as an example.

Figure 1:
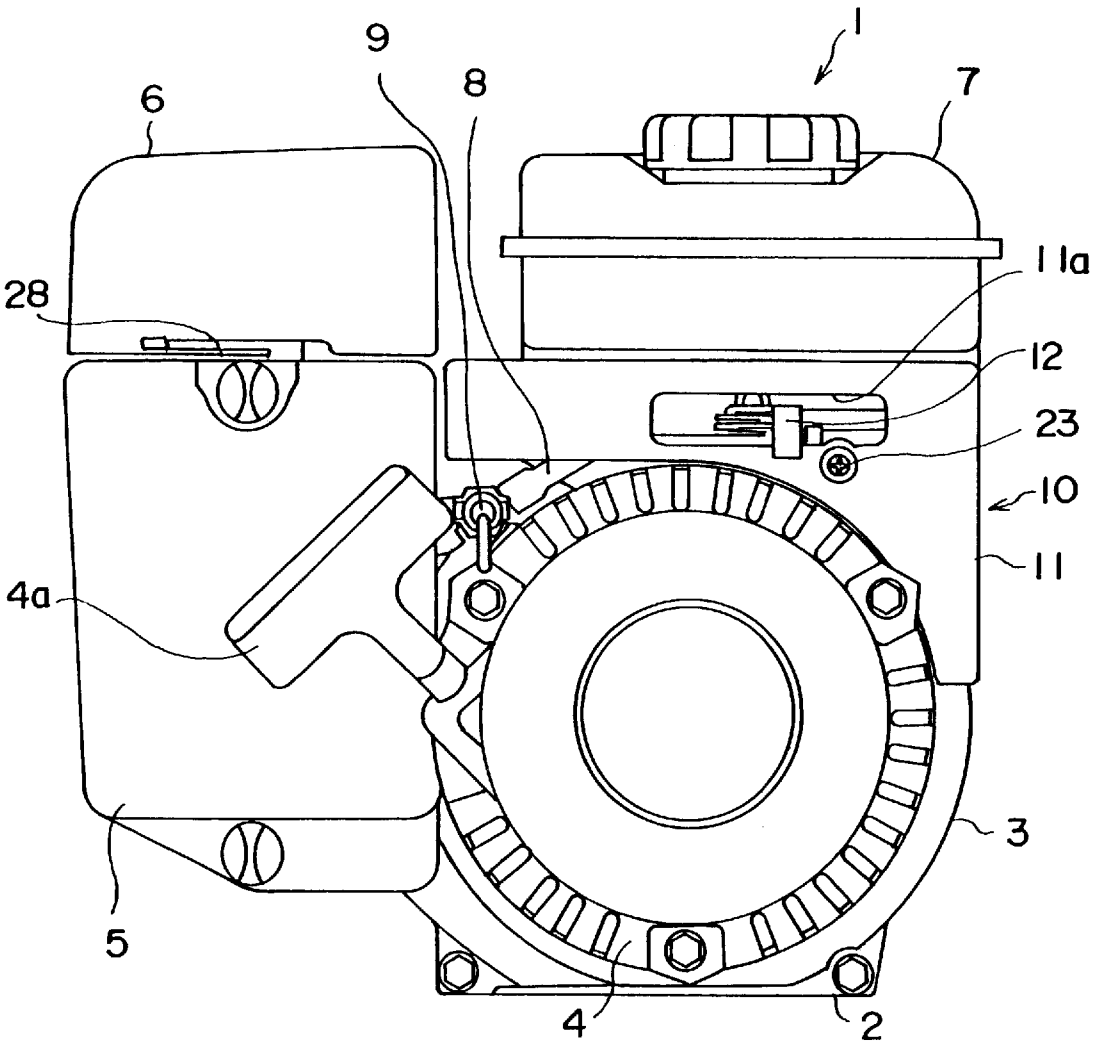
FIG. 1 is a frontal view of an inclined-cylinder type single-cylinder engine which is an ideal embodiment of this invention.
Figure 2:
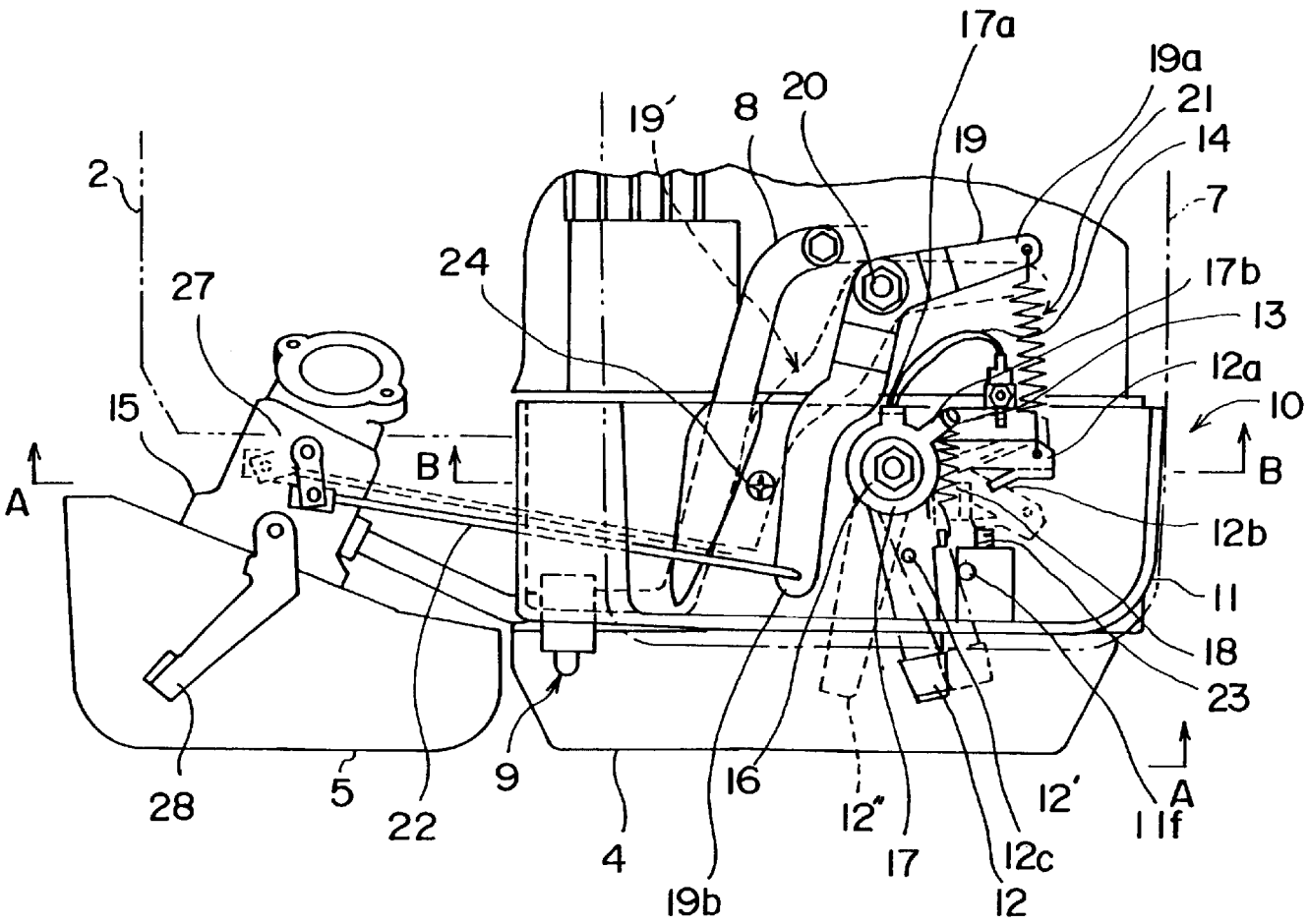
FIG. 2 is a plan view of the area where the throttle operates in the embodiment referred to above.
Figure 3:
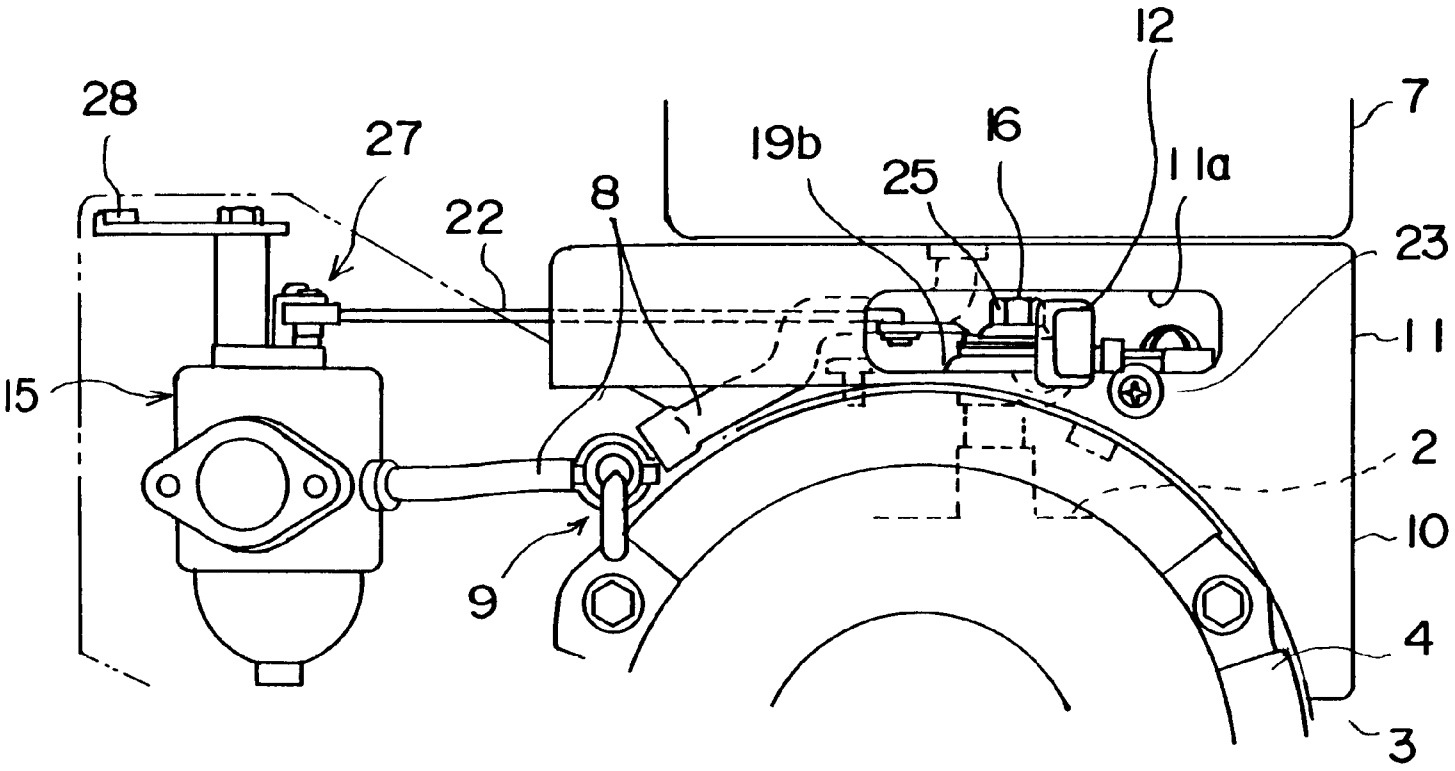
FIG. 3 is a view of FIG. 2 from line A—A.
Figure 4:
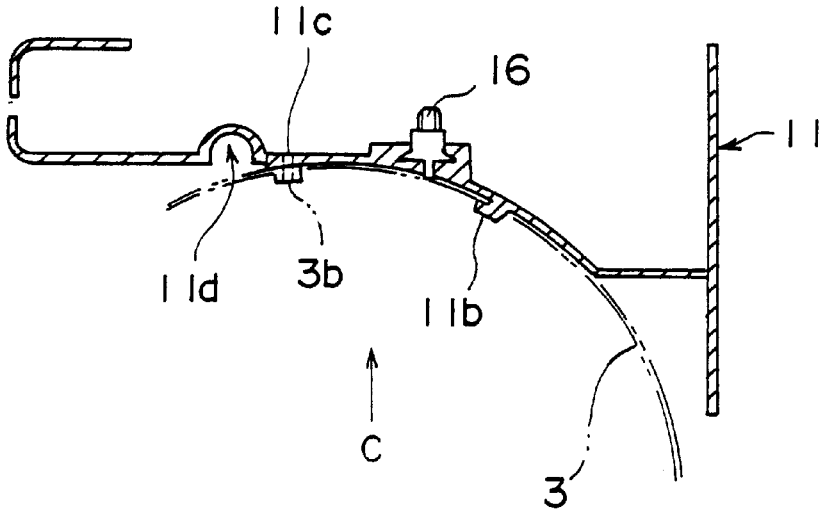
FIG. 4 is a view of FIG. 2 from line B—B.
Figure 5:
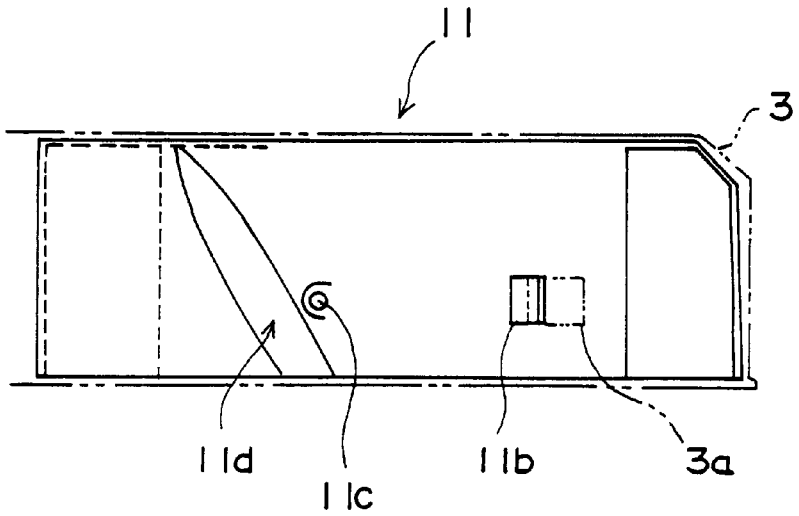
FIG. 5 is a view of FIG. 4 from C.
Figure 6:
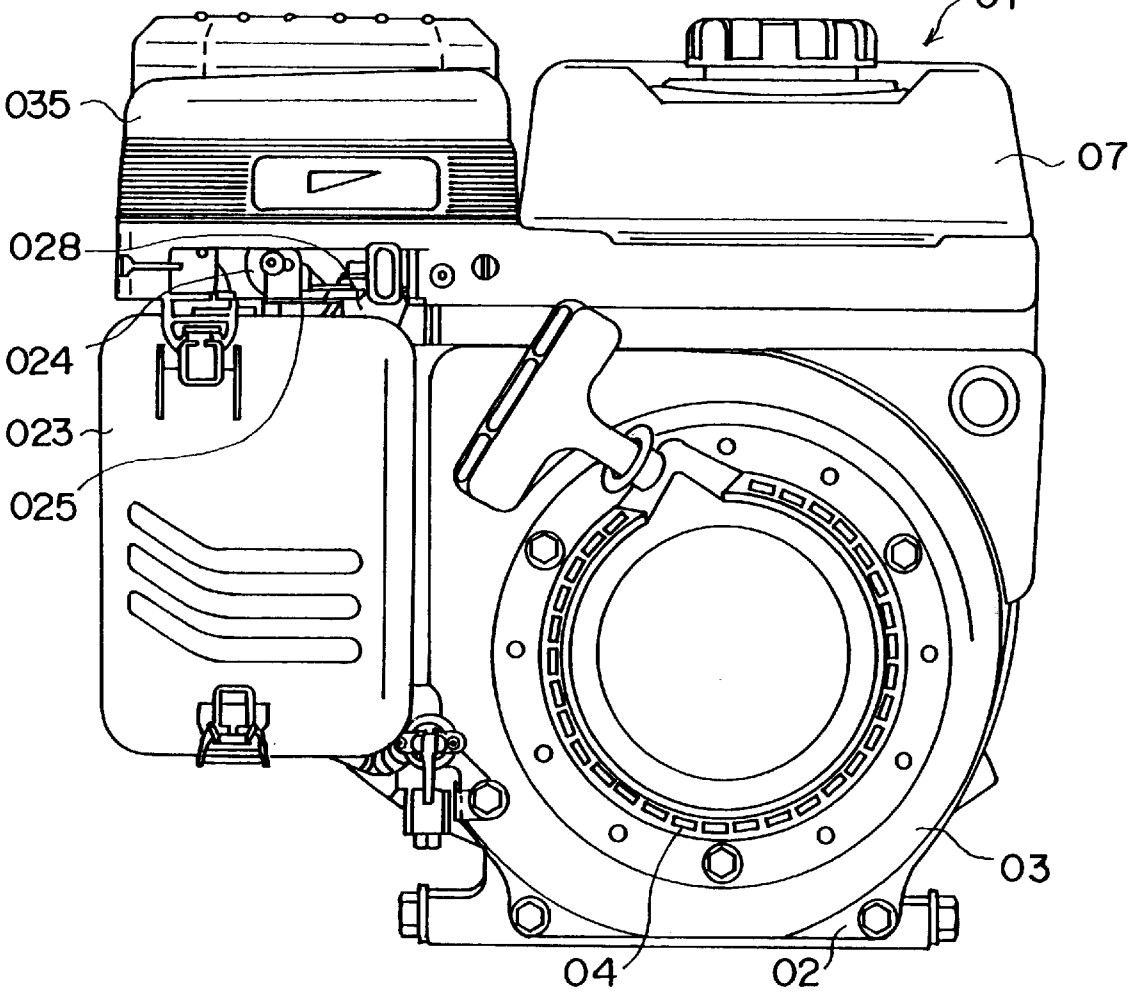
Fig. 6 PRIOR ART
FIG. 6 is a full frontal view of an inclined cylinder-type single-cylinder engine for general use belonging to the prior art.

FIG. 1 is a frontal view of an inclined-cylinder type single-cylinder engine which is an ideal embodiment of this invention. FIG. 2 is a plan view of the portion of the same figure in which the operation of the throttle can be seen. FIG. 3 is the view seen from line A—A in FIG. 2. FIG. 4 is the view seen from line B—B in FIG. 2. FIG. 5 is the view seen looking in the direction shown by arrow C in FIG. 4.

In these figures, 1 is the engine body and 2 is the engine body including the crankcase. On the front of the said engine body 2 are cover 3, formed from a metal plate, and recoil starter 4, which is used to start engine body 1. 4*a* is the handle of the said recoil starter.

7 is the fuel tank, which is placed atop the engine body 2. 15 is the carburetor. Between the fuel tank 7 and carburetor 15 is fuel pipe 8, which goes from the upper portion of engine body 2 along the front of the engine. Fuel cock 9 is placed partway along the said fuel pipe 8. Air cleaner 5 is connected to the carburetor 15. The outer surface (i.e., the front surface) of air cleaner 5 is flush with the front surface of the fan cover 3 on the left side of engine body 1. 6 is the muffler cover, which encloses the sound-damping muffler (not pictured) attached to the exhaust pipe of engine body 1. 28 is the choke lever, which operates the choke valve on the carburetor 15.

10 is the operating panel, which is located between fuel tank 7 and fan cover 3 on the upper portion of the front surface of the engine.

The aforesaid operating panel 10 is formed of molded resin. It consists of custom-designed cover 11, which faces the front surface of engine body 1; vertical shaft 16, which serves as the mounting stage for throttle control lever 12 (to be discussed shortly), and which is supported on the said vertical shaft 16 in such a way that it is free to rotate; and cut-off terminal 13, which is mounted on the inside of the custom-designed cover in such a way that it is insulated.

The end of the operating knob of the throttle control lever 12 protrudes frontward to the exterior through rectangular hole 11 in the front surface of the custom-designed cover 11 so that the lever can be operated from the exterior within the range shown in FIG. 2, from high speed position 12" to stop position 12'. The cut-off terminal 13 is connected to primary wire 14 of the ignition coil.

Cut-off terminal 13 is installed in custom-designed cover 11, which, as mentioned above, is formed of a resinous material which provides electrical insulation. It can be in contact with the throttle control lever 12, which is grounded and connected to the fan cover 3 through vertical shaft 16. This has the effect of grounding primary wire 14 of the ignition coil so as to create a cut-off switch mechanism to cut off engine body 1 which is engaged to the throttle. This design obviates the need for the additional insulating material which was required in prior art designs.

The custom-designed cover 11 is shown in FIGS. 4 and 5. A protrusion 11*b* with a horizontal groove in it is located on the lower portion of custom-designed cover 11. This protrusion 11*b* is inserted into square hole 3*a,* which is in the upper portion of fan cover 3. It is then forced to the left as shown in FIGS. 4 and 5. The horizontal groove on the inner side of protrusion 11*b* engages in square hole 3*a* in fan cover 3. Mounting hole 11*c* in custom-designed cover 11 is aligned with screw hole 3*b* in fan cover 3. When anchor screw 24 (see FIG. 2) is screwed into hole 3*b,* the custom cover is anchored to fan cover 3.

17 is a metal washer. It supports the thrust surface of the throttle control lever 12, and at the same time its extension 17*b* supports the end of draft spring 18. The other extension 17*a* of the said washer 17 is bent so as to engage in a depression in cover 11 when it bents and locks. The other end of the draft spring 18 engages with the midportion of throttle control lever 12. The draft spring 18 provides force by pulling toward the low-speed side, or safety side, of the throttle control lever 12.

Draft spring 18 is provided for occasions on which the throttle is operated through control lever 12 by a wire. In normal configurations, when the lever is operated manually, the spring is not needed.

The throttle control lever 12 is tightened to engine body 2 by nut 25, with a dish-shaped spring (not pictured) under the nut. The force used to tighten the nut will allow throttle control lever 12 to rotate freely. The force of friction is adjusted so that the lever can stop at any stop position desired.

As can be seen in FIG. 2, there is a hole 12*c* in the middle of the long dimension of the throttle control lever 12. By engaging in hole 12*c,* a protrusion (not pictured) integral to the custom-designed cover 11 performs the function of limiting the position of the throttle lever corresponding with the lowest rotational speed of engine body 1. A stopper pin 11*f* is formed integral to the aforesaid custom-designed cover 11. Stopper pin 11*f* has the function to stop the said lever 12 and lock it in a position where contact lever 12*b* is in contact with the cut-off terminal 13, when the throttle control lever 12 rotates from the low-speed position further in the direction of decreasing speed.

23 is an adjustment screw which goes from the front surface of custom-designed cover 11 toward the interior of the cover. Adjusting the tightness of screw 23 adjusts the tension of governor spring 21 to control the maximum r.p.m. of engine 1.

Normally, a centrifugal-type mechanical governor unit is used as the unit which adjusts the maximum r.p.m. of engine body 1. (We shall not discuss its internal configuration.) In FIGS. 2 and 3, the centrifugal force generated by the rotation of the crankshaft (not pictured) of engine body 1 is converted to torque and output to the exterior via governor shaft 20, which projects outward from the upper portion of engine body 2. 19 is a governor unit with two arms, 19*a* and 19*b,* which are fixed to governor shaft 20. One end of the governor spring 21 engages in the hole on the end of the said arm 19*a.* The other end of spring 21 engages with arm 12*a* of throttle control lever 12. Operating rod 22 is secured to one end of arm 19*b* of the aforesaid governor unit 19 in such a way that it is free to rotate. The other end of the said operating rod 22 is secured to accelerator lever 27 of carburetor 15 in such a way that it is free to rotate.

In such an engine body 1, when the r.p.m. of the engine exceeds a given value, the centrifugal force increases, and the pulling force of the end of arm 19*a* of governor unit 19 resulting from the torque of governor shaft 20 is defeated by the tension of governor spring 21. Governor unit 19 swings in the direction which appears as counterclockwise in FIG. 2, and is driven through operating rod 22 and accelerator lever 27 in the direction which closes the throttle valve (not pictured) of carburetor 15. The speed of the engine is reduced to the specified r.p.m.

When the r.p.m. of the engine falls below a given value, the centrifugal force experienced by the governor unit diminishes, and the tension of governor spring 21 is defeated by the pulling force of the end of arm 19*a* of governor unit 19 resulting from the torque of governor shaft 20. Governor unit 19 swings in the direction which appears as clockwise in FIG. 2, and is driven in the direction which opens the throttle valve (not pictured) of carburetor 15. The speed of the engine is increased to the specified r.p.m. In this way the rotational speed of engine body 1 can be maintained at a specified value.

We shall next discuss the configuration used to support the aforesaid fuel pipe 8. Custom-designed cover 11 for the aforesaid throttle operating panel 10 is shown in FIGS. 4 and 5. Groove 11*d,* which has a semicircular cross section, traverses the undersurface of the cover obliquely. The aforesaid fuel pipe 8 runs from fuel tank 7 to carburetor 15 within semicircular groove 11*d.* It is held in place by the pressure of fan cover 3. Thus fuel pipe 8 can be secured reliably without additional clamps or other hardware merely by being pressed into the aforesaid groove 11*d* by fan cover 3. This reduces the time and effort needed to mount the fuel pipe.

According to this invention, as was explained above, a custom-designed cover made of a resinous material is installed between the top of the fan cover and the bottom of the fuel tank. The custom-designed cover encloses the uneven portion on the upper part of the front of the engine. The vertical shaft, which serves as the mounting stage for the throttle control lever, is formed so as to engage with the custom cover. As is described in claim 2, the custom cover is mounted on the fan cover without the use of a large number of bolts. A protrusion on the custom cover fits into a hole in the fan cover and is anchored by a screw. The fuel pipe is supported by being run through a hemispherical groove which is integral to the custom cover with the top of the fan cover pressing against it. No clamps, bolts or other hardware is needed. The parts count is much lower than that required by designs belonging to the prior art, and fewer assembly processes are needed.

A cut-off terminal to cut-off switch is installed directly in the custom-designed cover, which is made from a resin capable of providing electrical insulation. Causing the cut-off terminal to be in contact with the fan cover allows it to be used to cut off the engine. There is no need for additional insulating material for a cut-off switch, and the configuration of the cut-off switch is much simpler than in prior art devices.

This invention, then, has the effect of reducing the parts count and the number of assembly processes. It allows us to achieve a single-cylinder engine for general use at a lower cost, a very advantageous effect.

We claim:

1. An operating panel installed in a one-cylinder engine in which said cylinder is inclined with respect to an engine body having a crankcase, a fuel tank placed in an upper part of said engine body, and a fan cover on front of said engine body, comprising:

a custom-designed cover made of a resin material which encloses an uneven portion on front of said engine body between an upper part of said fan cover and a lower part of said fuel tank;

a throttle lever which protrudes outward through a hole in said cover, which can rotate around a vertical shaft integral to said cover and placed on its interior, and can be stopped in any angular position desired; and a cut-off switch to stop said engine installed in said custom-designed cover, which has a cut-off terminal electrically isolated from a ground, and can electrically ground said cut-off terminal by making a contact with said throttle lever electrically grounded.

2. An operating panel according to claim 1, wherein said custom-designed cover has a protrusion with a horizontal groove on a lower portion of said custom-design, said fan cover has a hole on an upper portion of said fan cover, and said horizontal groove of said protrusion and said hole of said fan cover are engaged together, then fixed with an anchor screw which is located a specified distance from said protrusion and said hole.

3. An operating panel according to claim 1, wherein said custom-designed cover has a groove with a semicircular cross section on a bottom portion, and a fuel pipe runs within said groove being pressed into said groove by a top portion of said fan cover.

* * * * *